United States Patent [19]

Saito et al.

[11] 4,146,596

[45] Mar. 27, 1979

[54] INTAKE SYSTEM OF AN INTERNAL COMBUSTION ENGINE

[75] Inventors: Masaaki Saito, Yokosuka; Mitsumasa Inoue, Yokohama, both of Japan

[73] Assignee: Nissan Motor Company, Limited, Yokohama, Japan

[21] Appl. No.: 887,726

[22] Filed: Mar. 17, 1978

Related U.S. Application Data

[63] Continuation-in-part of Ser. No. 705,579, Jul. 15, 1976, abandoned.

[30] Foreign Application Priority Data

Jul. 31, 1975 [JP] Japan ..... 50-92537

[51] Int. Cl.[2] ..... F02M 29/14

[52] U.S. Cl. ..... 261/78 R; 48/180 M; 123/141; 261/65; 261/DIG. 39; 261/DIG. 55

[58] Field of Search .... 261/78 R, DIG. 55, DIG. 39, 261/65; 48/180 M; 123/141, 122 AC

[56] References Cited

U.S. PATENT DOCUMENTS

| | | | |
|---|---|---|---|
| 1,131,371 | 3/1915 | Hatfield | 123/141 |
| 2,102,800 | 12/1937 | Killmeyer et al. | 261/DIG. 39 |
| 2,752,131 | 6/1956 | Gretz | 261/78 R |
| 3,298,677 | 1/1967 | Anderson | 261/65 |
| 3,393,984 | 7/1968 | Wisman | 261/65 |
| 3,810,607 | 5/1974 | Blohm | 261/DIG. 39 |
| 3,868,936 | 3/1975 | Rivere | 261/DIG. 39 |
| 3,872,849 | 3/1975 | Chester et al. | 123/122 AC |
| 4,012,468 | 3/1977 | Kikuchi | 261/78 R |

FOREIGN PATENT DOCUMENTS

| | | | |
|---|---|---|---|
| 451559 | 10/1927 | Fed. Rep. of Germany | 123/141 |
| 969497 | 5/1950 | France | 123/141 |
| 1233027 | 10/1960 | France | 261/65 |

*Primary Examiner*—Tim R. Miles

*Attorney, Agent, or Firm*—Fleit & Jacobson

[57] ABSTRACT

An intake system of an internal combustion engine having a carburetor with a primary venturi and a secondary venturi concentrically disposed within the primary venturi by a bridge member which extends into contact with an inner wall of a throat portion of the primary venturi. A fuel delivery conduit is disposed within the bridge member and spans the secondary venturi with its leading end sealingly received in the side of the secondary venturi opposite the bridge member. The fuel delivery conduit is inclined with respect to the axis of the secondary venturi so that the leading end portion of the conduit extends in an upstream direction. The fuel delivery conduit also has an opening through which fuel is dischargable. A single needle member is fixedly attached to the bottom of the secondary venturi and projects in a downstream direction with respect to the flow of the air passing through the secondary venturi. The needle member is in substantial axial alignment with the portion of the secondary venturi from which the spanning fuel delivery conduit projects into the secondary venturi.

8 Claims, 33 Drawing Figures

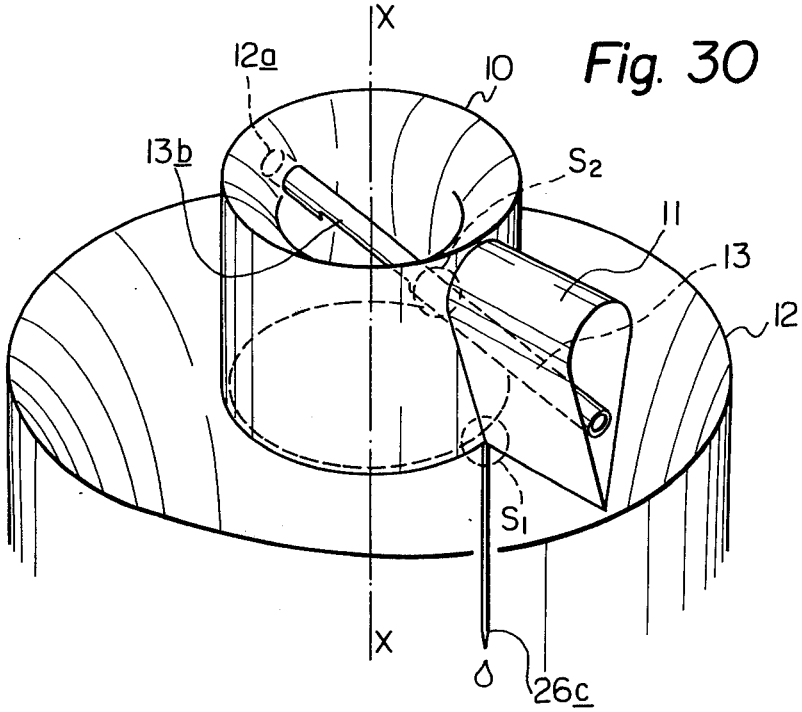
Fig. 30
Fig. 31a
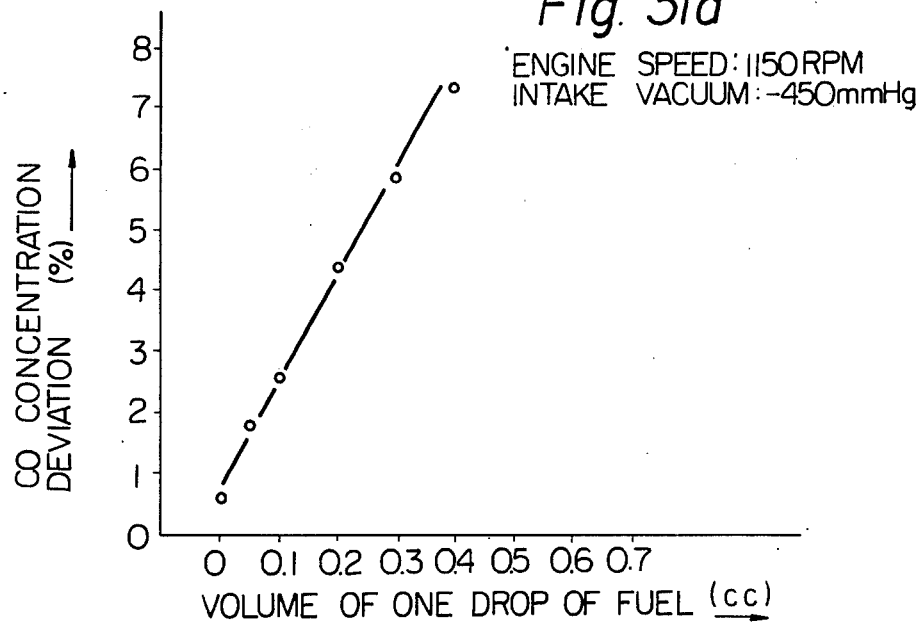

INTAKE SYSTEM OF AN INTERNAL COMBUSTION ENGINE

BACKGROUND OF THE INVENTION

This application is a continuation-in-part of our application Ser. No. 705,579 filed on July 15, 1976 and now abandoned.

FIELD OF THE INVENTION

The present invention relates in general to an improved intake system of an internal combustion engine, and more particularly to an improved air-fuel mixture passage means which can provide preferable charge transfer to the engine proper for optimum operation of the engine.

DESCRIPTION OF THE PRIOR ART

It is usually observed that, during passage of an air-fuel mixture through conduit portions of a carburetor and an intake manifold, a certain amount of liquid fuel drops out of the mixture and spreads in a thin layer over inner surfaces of the conduit portions. This phenomenon happens because the air-fuel mixture leaving the carburetor is not in gaseous form, but a mixture of air and small liquid fuel droplets (which are called atomized fuel). The liquid fuel spreading over the surfaces then slowly flows down along the surfaces and gathers by its surface tension at downwardly projected sections of some of the parts, such as a venturi portion, a throttle valve, a throttle valve chamber wall and an extension riser. The fuel then forms fuel droplets dangling from the projected sections.

The trouble is that these droplets fall down, drop by drop, from the projected sections, after reaching a considerably large size. This dropping of the droplets causes an abrupt change in the air-fuel ratio of the mixture admitted into the combustion chambers, thereby preventing stable operation of the engine and simultaneously causing large noxious exhaust gas emissions.

In a vehicle running at about 20 km/h, the dropping of one droplet having a volume of 0.05 to 0.2 cc will make an air-fuel ratio variation ($\Delta$ A/F) of about 0.8 to 3.0. This phenomenon becomes a bigger problem when the vehicle is subjected to low speed running, gear change operation and/or acceleration. Furthermore, if the engine is of a type equipped with a so called three-way catalytic converter requiring very stable air-fuel ratio, this phenomenon becomes even more serious.

SUMMARY OF THE INVENTION

Accordingly, the present invention eliminates the drawbacks of the prior art air-fuel mixture passage means mentioned above.

It is an object of the present invention to provide an improved air-fuel mixture passage means by which uniform air-fuel mixture transfer to the combustion chambers is achieved to ensure stable operation of the engine and thus to considerably reduce noxious exhaust emissions from the engine.

It is another object of the present invention to provide an improved air-fuel mixture passage means in which the liquid fuel spreading over the inner surfaces is gathered on a sharply pointed member to form a relatively small droplet readily releasable from the pointed member thus providing relatively uniform air-fuel mixture to the engine.

It is still another object of the present invention to provide an improved air-fuel mixture passage means which is economically made and is simple in construction.

BRIEF DESCRIPTION OF THE DRAWING

Other objects and advantages of the improved air-fuel mixture passage means according to the present invention will become apparent from the following detailed description, when taken in conjunction with the accompanying drawings, in which:

FIGS. 1 and 2 are views of secondary venturi portions, FIGS. 3 to 5 are views each showing main parts of the conventional carburetor;

FIGS. 10 to 29 are sectional side views of parts of an improved carburetor and its neighbors which are embodiments of the present invention, in which FIG. 15 is a view taken on line A—A of FIG. 14 and FIG. 25 is a view taken on line B—B of FIG. 23;

FIG. 30 is another view of the embodiment illustrated in FIG. 12; and

FIGS. 31*a*, 31*b* and 31*c* are graphs used to illustrate both the need for applicants' invention and benefits obtained from the use of the disclosed invention.

DESCRIPTION OF THE PREFERRED EMBODIMENTS

Figure 1:
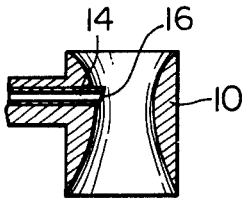
FIGS. 1 to 5 are sectional side views of parts of a conventional carburetor, at which parts relatively large sized fuel droplets are liable to form. In these figures.
Figure 2:
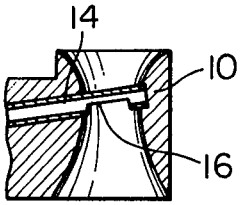
Figure 3:
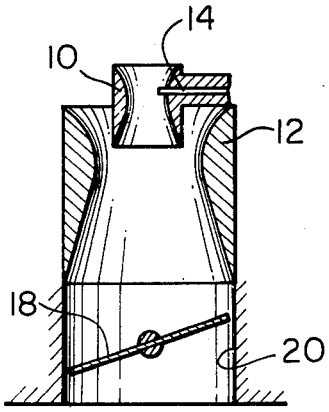
Figure 4:
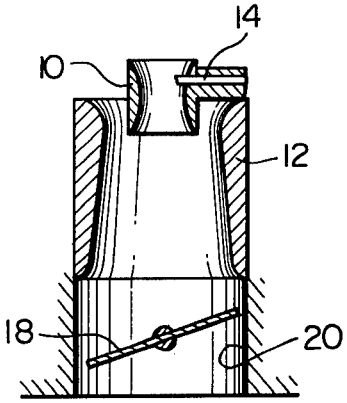
Figure 5:
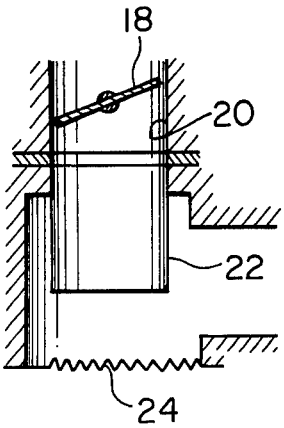
Figure 6:
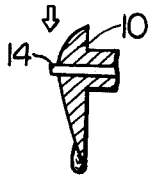
FIGS. 6 to 9 show the manner in which the fuel droplets are formed at downwardly projected portions of the parts in the conventional carburetor.
Figure 7:
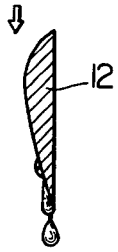
Figure 8:
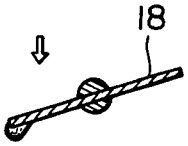
Figure 9:
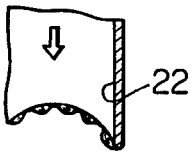

In FIGS. 1 to 9, a secondary venturi and a primary venturi are designated by reference numerals 10 and 12, respectively. A main fuel conduit 14, a fuel nozzle 16, a throttle valve 18, a throttle valve chamber having a side wall 20, an extension riser 22 and an air-fuel mixture heater 24 are also shown. In FIGS. 6 to 9, the flow direction of the air-fuel mixture is indicated by arrows. As shown, the relatively large sized fuel droplets are illustrated forming on downwardly projected portions of the parts.

In the following description, the parts carrying the same numerals as in FIGS. 1 to 9 indicate the same parts described hereinbefore.

Figure 10:
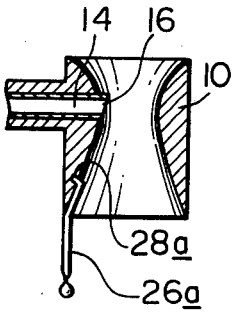
Figure 11:
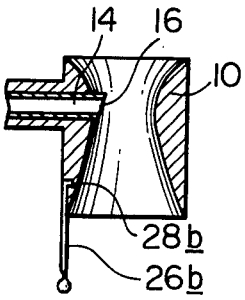
Figure 12:
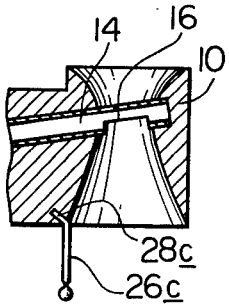

Referring now to FIGS. 10 to 12 of the drawings, there are respectively shown three kinds of secondary venturi portions which are embodied by the present invention. As well shown in each of FIGS. 10 to 12, a needle member 26*a* (26*b* and 26*c*) is connected at its upper bent end 28*a* (28*b* and 28*c*) to the lower section of the secondary venturi 10. It should be noted that the lower end of the needle member 26*a* (26*b* and 26*c*) is formed into a sharp point for the reason which will be described below. In one embodiment, the needle member has a cylindrical base or body having a diameter of between approximately 0.8 mm and 1.1 mm which tapers to a point at its lower end.

With the provision of the needle member 26*a* (26*b* and 26*c*), the liquid fuel spreading over the surface portions of the secondary venturi 10 is caused to gather at the pointed lower end of the needle member 26*a* for formation of the fuel droplet, after sliding down along the lower peripheral edge of the venturi 10. However, in this case, the droplet is caused to fall down instantly. More specifically speaking, the droplet falls down considerably before it develops a large size. This is because the sharply pointed lower end of the needle member 26a (26b and 26c) does not offer a sufficient contacting surface to hold a fuel droplet having a relatively large size.

Now, it should be noted that the conventional carburetor has made at its downwardly projected portion a fuel droplet having a relatively large volume of about 0.05 to 0.2 cc; however, by the provision of the needle member, the volume of the fuel droplet is reduced to a degree below about 0.02 cc. In view of the air-fuel ratio variation (Δ air/fuel) with the vehicle running at a speed of 20 km/hr, the conventional carburetor has a variation ranging from 0.8 to 3.0, while the carburetor with the needle member brings the variation to about 0.5. In other words, by the present invention, the variation degree is reduced by about ½ to 1/6. Thus, in this instance, stable operation of the engine is achieved with reduced noxious exhaust emissions.

To further clarify the relationship between FIG. 12 and a conventional carburetor, reference is made to FIG. 30 which is an expanded perspective view of FIG. 12. A wall member of the carburetor defines a primary venturi 12. A housing or wall forming a secondary venturi 10 is concentrically disposed within the primary venturi 12 by a bridge member 11 extending from an inner wall of a throat portion of the carburetor. A fuel delivery conduit 13 passes through the bridge member 11 and spans the secondary venturi 10. A leading end 13a of the conduit 13 is sealingly received in a wall of the secondary venturi 10 opposite the bridge member 11. The fuel delivery conduit is inclined with respect to a horizontal plane and has its leading end 13a extending upstream in the secondary venturi. An opening 13b is formed in the conduit for the discharge of fuel. The needle member 26c is fixedly attached to the wall of the secondary venturi so as to project from a portion $S_1$ of the most downstream peripheral edge of the internal surface of the secondary venturi 10 in a downstream direction with respect to the flow of air passing through the secondary venturi. The portion $S_1$ is substantially nearest or in vertical alignment with a portion $S_2$ from which the spanning fuel delivery conduct 13 projects into the secondary venturi 10. Also, the bottom of the bridge member 11 is flush with the bottom of the housing defining the secondary venturi 10.

In the embodiment illustrated in FIGS. 12 and 30, the following points are important features of the subject invention:

(1) The needle member 26c is fixed to the portio.

(2) The portion $S_1$ is located adjacent to the lowei most portion of the bridge member 11.

As will be understood from FIGS. 12 and 30, liquid fuel undesirably flowing from the fuel opening 13b gathers mainly at the portion $S_1$. This is because the portion $S_1$ is nearest to the portion $S_2$ from which the spanning fuel delivery conduit 13 projects into the venturi 10 and the conduit 13 is inclined relative to the axis X—X of the venturi 10. Furthermore, under such construction, there will be produced a vortex flow of the air-fuel mixture at a position just under the bridge member 11 during the functional operation of the carburetor. Thus, liquid fuel gathering at the portion $S_1$ is forced to move or transfer toward the lowermost portion of the bridge member 11 without forming a large fuel drop.

Positioning of the needle member 26c on the portion $S_1$ therefore achieves the most effective function thereof.

Referring now to FIG. 31a, the effect of the volume of one drop of fuel on the concentration deviation of CO in the exhaust gases is illustrated. The CO concentration deviation is given by the following equation.

$$D = C_1 - C_0$$

where:

D . . . . CO concentration deviation;

$C_1$ . . . . CO concentration given when the selected one drop of fuel is supplied to the running engine; and $C_0$ . . . . CO concentration given when the engine runs without being fed with such fuel drops.

From the graph in FIG. 31a, it will be appreciated that the CO concentration deviation in the engine exhaust gases is proportionally increased with an increase of the volume of the fuel drop fed to the engine.

Figure 31B:
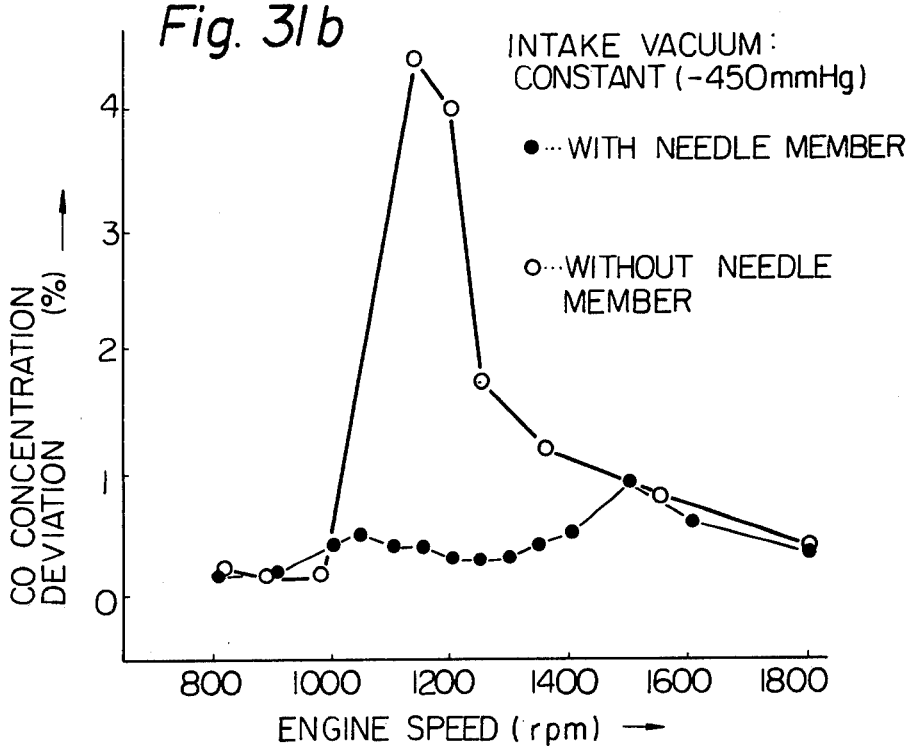
Figure 31C:
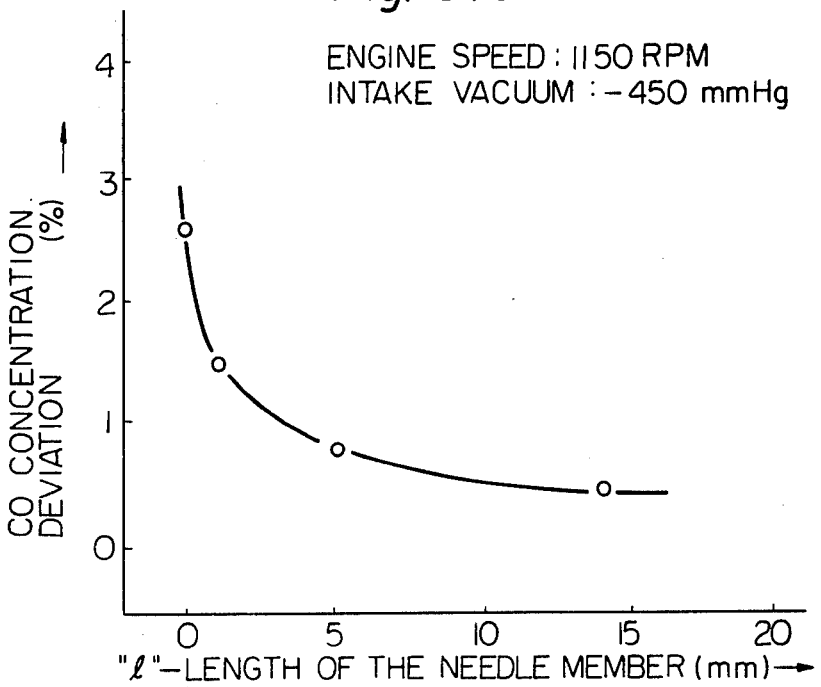

FIG. 31b illustrates the effect of the presence of the needle member 26c illustrated in FIG. 12 on the concentration deviation of CO in the exhaust gases. FIG. 31c illustrates the effects of variations in the length of needle member 26c on the concentration deviation. A four cycle, 2000 cc displacement engine, running at 1150 rpm, with an intake vacuum of (−450 mm Hg) was used to obtain the data illustrated in FIGS. 31a, 31b and 31c.

Figure 13:
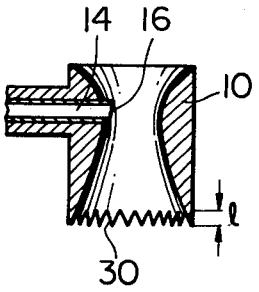
Figure 14:
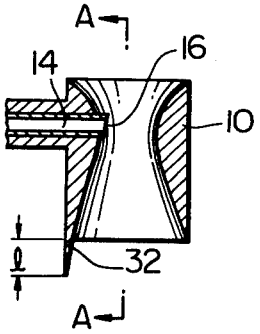
Figure 15:
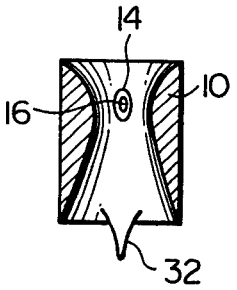
Figure 16:
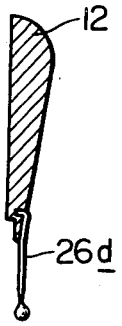
Figure 17:
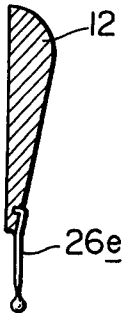
Figure 18:
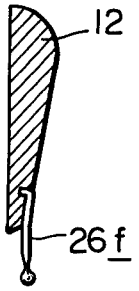
Figure 19:
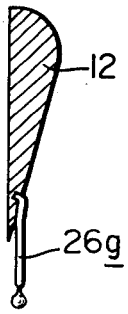

Referring to FIGS. 13 to 15, two other kinds of secondary venturi portions embodying the present invention are shown. In FIG. 13, the lower peripheral edge of the venturi 10 is integrally formed with a comb shaped portion 30 with a plurality of teeth each having sharply pointed ends as shown. In the case of FIG. 14 or FIG. 15, only one sharply pointed end portion 32 is formed to protrude from the lower peripheral edge of the venturi 10. These constructions are also advantageous as in the case of FIGS. 10 to 12.

Figure 20:
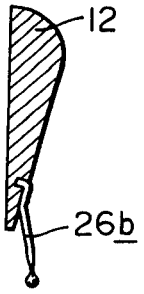

FIGS. 16 to 20 respectively show embodiments in which each of the needle members 26d to 26h is connected to the lower end portion of the primary venturi 12, in the same manner as mentioned with respect to FIGS. 10 to 12. As shown, several connections are available between the venturi 12 and the needle members 26d to 26h. In FIG. 20, the needle member 26h is shown to be slightly bent inwardly.

Figure 21:
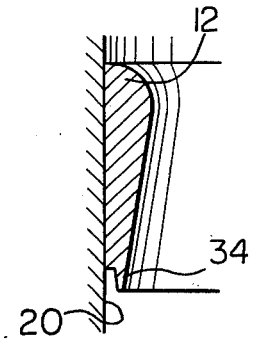
Figure 22:
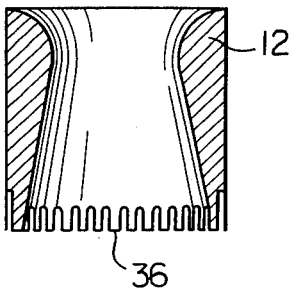

FIGS. 21 and 22 show embodiments in which the primary venturi 12 is formed with a projected portion or portions at its lower section. In FIG. 21, a downwardly projected portion 34 is shown spaced apart from the surface of the throttle valve chamber wall 20, further in FIG. 22, a plurality of projected portions 36 are shown.

Figure 23:
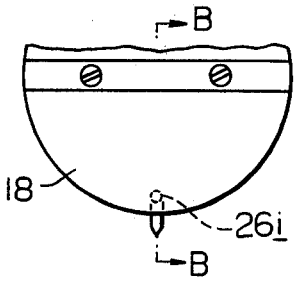
Figure 24:
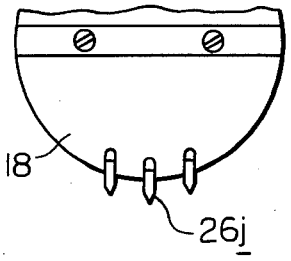
Figure 25:
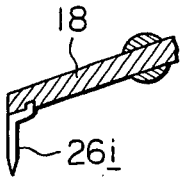

Referring to FIGS. 23 to 25, there are shown embodiments in which at least one needle member 26 i (26j) is connected to the downwardly rotatable side of the throttle valve 18. As well seen from FIG. 25, the needle member 26i is fixed at its upper end to the lower side of the throttle valve 18 and is bent so as to have a straight portion flush with the edge of the valve 18 for thereby obtaining smooth flowing of the fuel liquid from the surface of the throttle valve 18 toward the needle member 26i.

Figure 26:
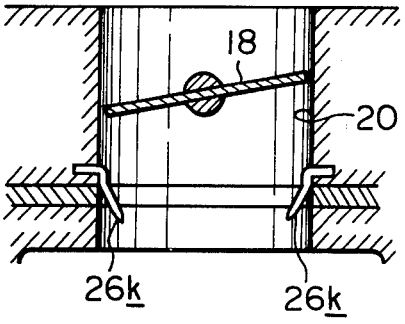
Figure 27:
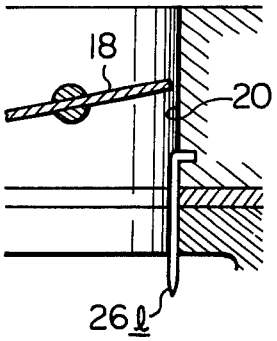

FIGS. 26 and 27 show embodiments wherein the throttle valve chamber wall 20 is provided with at least one needle member 26k (26l) at the position downstream of the throttle valve 18. As shown in FIG. 26, each of the needle members 26k may be slightly bent inwardly of the throttle valve chamber.

Figure 28:
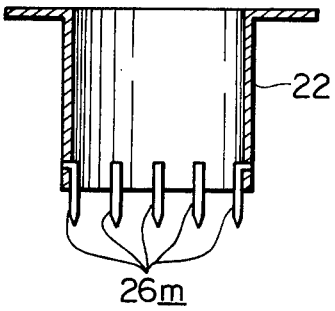
Figure 29:
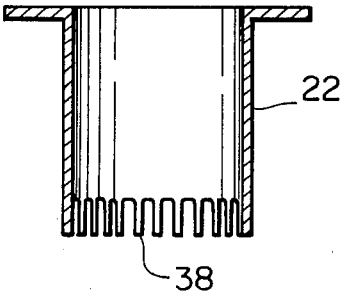

FIGS. 28 and 29 show embodiments wherein the extension riser 22 is provided or formed with downwardly projected members or portions at its lower end portion. In FIG. 28, a plurality of needle members 26m are connected at their upper ends to the lower inside surface of the extension riser 22. In FIG. 29, the lower end portion of the extension riser 22 is integrally formed with a comb shaped portion 38 with a plurality of teeth.

According to our experiments, the following results were obtained, in which:

(1) It has become clear that the needle member and the comb-shaped portion can effectively function when the length thereof (which is indicated by letter l in FIGS. 13, 14 and 30) is more than about 5 mm. As will be understood from FIG. 31C, the function of the needle member is almost saturated at about 8 mm in length.

(2) In connection with the number of the needle members used for the corresponding parts, only one needle member is required in the secondary venturi or the throttle valve. However, in the case of other parts, such as the primary venturi, the throttle valve chamber wall and the extension riser, it is better to use a plurality of needle members.

(3) The thickness or diameter of the body of the needle member effects the function of the needle member, a diameter between approximately 0.5 mm and 1.5 mm having been found effective, with a diameter between approximately 0.8 mm and 1.1 mm having been found most effective.

(4) It is preferred that the leading end of each tooth of the comb shaped portion be sharply pointed.

(5) In a case of employing a plurality of needle members, it is preferable that the distance defined between two neighbouring needle members be about 5 to 10 mm.

Although, in the prior description, the needle member and the comb-shaped portion are used in the carburetor and its adjacent parts, it is also possible to provide such projecting member or portion on the inner wall of an intake tube (such as an intake manifold).

From the above description, it will be apparent that the improved air-fuel mixture passage means of the present invention can provide a uniform transfer of the air-fuel mixture to the combustion chambers thereby achieving a stable operation of the engine with reduced noxious exhaust emissions.

It is now to be understood that the present invention is not to be limited to the exact constructions stated and shown and that many changes and modifications can be made without departing from the scope of the invention, as defined in the appended claims.

We claim:

1. An intake system for an internal combustion engine, comprising:

a carburetor including wall means defining a primary venturi, a housing defining a secondary venturi concentrically disposed within said primary venturi and including a bridge member extending into contact with an inner wall of a throat portion of said wall means, a fuel delivery conduit disposed through said bridge member and so constructed and arranged as to span said secondary venturi and to have a leading end thereof sealingly received in the housing of said secondary venturi opposite said bridge member, said fuel delivery conduit being inclined with respect to the axis of said secondary venturi so that the leading end portion thereof extends upstream, said fuel delivery conduit being further formed with an opening through which fuel is dischargable; and a single needle member fixedly attached to the housing of said secondary venturi so as to project from a portion of the most downstream peripheral edge of the internal surface of said housing in a downstream direction with respect to the flow of the air passing through said secondary venturi, said portion being attached to said most downstream peripheral edge in substantial axial alignment with a portion of said housing from which the spanning fuel delivery conduit projects into said secondary venturi.

2. An intake system as claimed in claim 1, in which said needle member extends in a direction substantially parallel to the axis of said secondary venturi.

3. An intake system as claimed in claim 2, in which the length of said needle member is more than 5 mm.

4. An intake system as claimed in claim 3, in which the length of said needle member is more than 8 mm.

5. An intake system as claimed in claim 3, in which the most downstream peripheral edge of said housing of said secondary venturi is flush with that of said bridge member.

6. An intake system as claimed in claim 3, in which said needle member has a cylindrical base portion with a diameter ranging from about 0.5 mm to about 1.5 mm.

7. An intake system as claimed in claim 3, in which said needle member has a cylindrical base portion with a diameter at least 0.8 mm and not more than 1.1 mm in circumference.

8. An intake system of an internal combustion engine, comprising:

a carburetor including a primary venturi, a secondary venturi concentrically disposed within said primary venturi by means of a bridge member extending from an inner wall of a throat portion of said carburetor, a fuel delivery conduit for delivering fuel to said secondary venturi disposed through said bridge member and so constructed and arranged as to span, said secondary venturi and to have a leading end thereof sealingly received in said secondary venturi opposite said bridge member and a throttle valve operatively disposed in a conduit portion of the carburetor downstream of said primary and secondary venturis;

said secondary venturi being formed with a throat defining the narrowest passage thereof to which said fuel delivery conduit opens, an upper end portion of said secondary venturi located upstream of said throat, and a lower end portion located downstream of said throat; and a needle member having an upper end connected to said lower end portion of said secondary venturi at a position just under said fuel delivery conduit, and a sharply pointed lower end extending in the downstream direction with respect to said venturis.

* * * * *